United States Patent [19]

Asai et al.

[11] 3,957,420

[45] May 18, 1976

[54] LOW $NO_X$ EMISSION BURNERS

[75] Inventors: Minoru Asai, Kamagaya; Takehiro Takamoto, Yokohama; Mikio Ikeda, Machida; Eiji Irahara, Tokyo, all of Japan

[73] Assignee: Ishikawajima-Harima Jukogyo Kabushiki Kaisha, Tokyo, Japan

[22] Filed: Dec. 16, 1974

[21] Appl. No.: 533,305

[52] U.S. Cl. ..... 431/175; 431/190; 431/351

[51] Int. Cl.[2] ..... F23C 5/20

[58] Field of Search ..... 122/356; 431/8, 9, 116, 431/175, 178, 190, 351

[56] References Cited

UNITED STATES PATENTS

| | | | |
|---|---|---|---|
| 3,028,907 | 4/1962 | Hensel | 431/190 X |
| 3,101,769 | 8/1963 | Zink et al. | 431/175 |
| 3,230,052 | 1/1966 | Lee, et al. | 122/356 |
| 3,438,346 | 4/1969 | Ott | 431/9 |

FOREIGN PATENTS OR APPLICATIONS

| | | | |
|---|---|---|---|
| 596,819 | 4/1960 | Canada | 122/356 |

*Primary Examiner*—Kenneth W. Sprague
*Attorney, Agent, or Firm*—Scrivener Parker Scrivener & Clarke

[57] ABSTRACT

The invention discloses a low $NO_x$ emission burner for use with an apparatus in which the material or materials are heated by the heat radiated from the radiation surface which is heated by the combustion by the burners. The secondary air injection ports or outlets are so arranged as to inject the secondary air upon the radiation surface to control the combustion, thereby reducing the release of $NO_x$ without producing CO and soot.

4 Claims, 10 Drawing Figures

PRIOR ART
Fig. 1
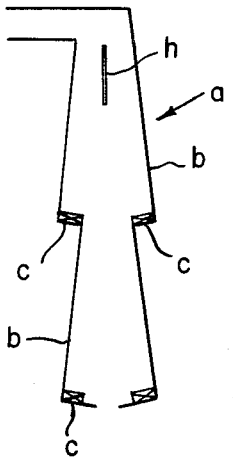
Fig. 2
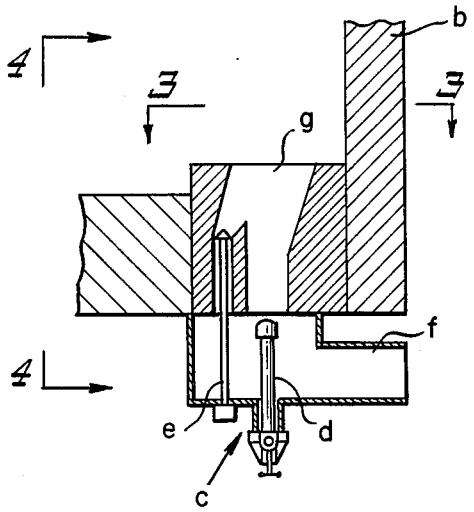
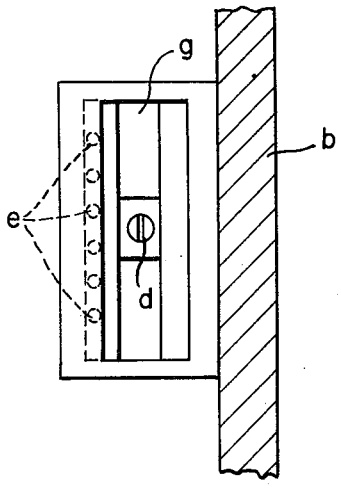
Fig. 3
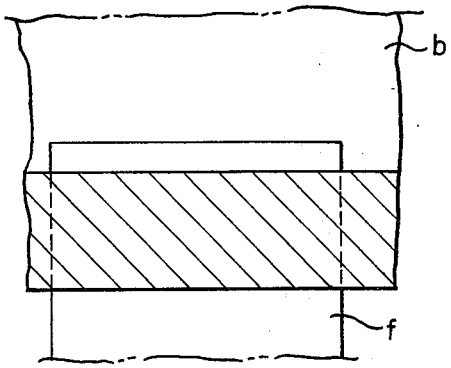
Fig. 4

Fig. 5
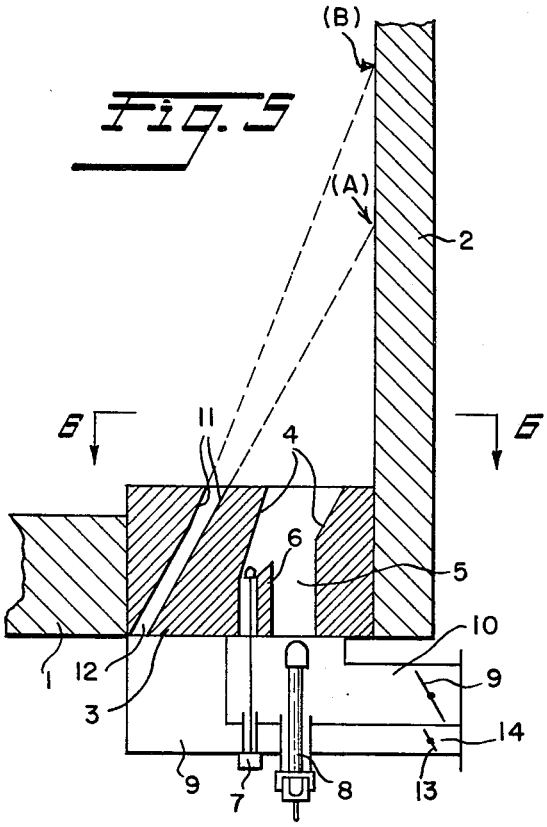
Fig. 7
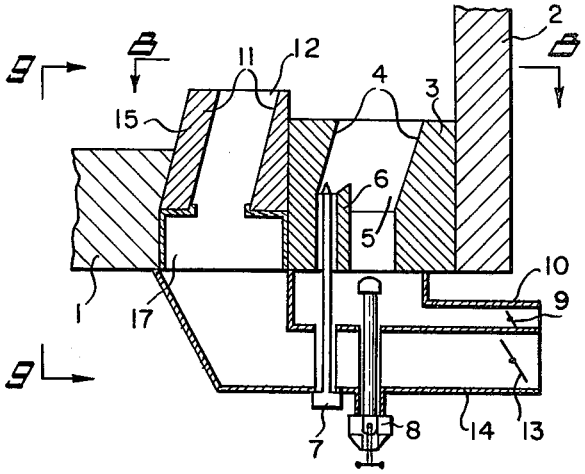
Fig. 8
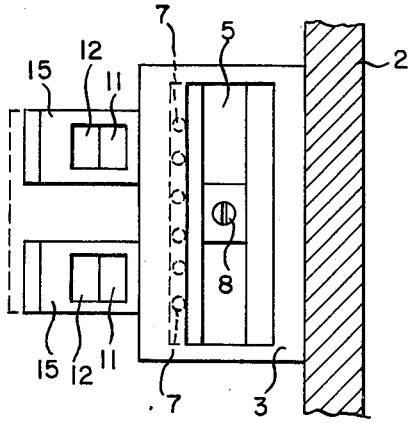
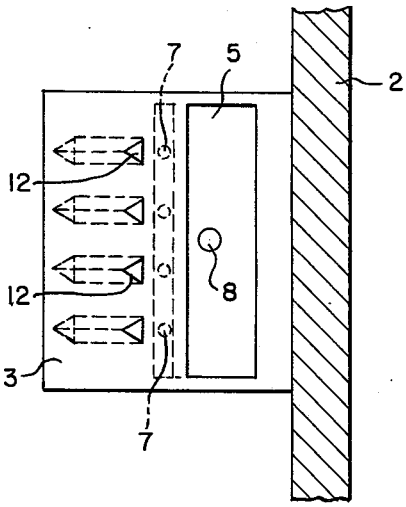
Fig. 6
Fig. 9
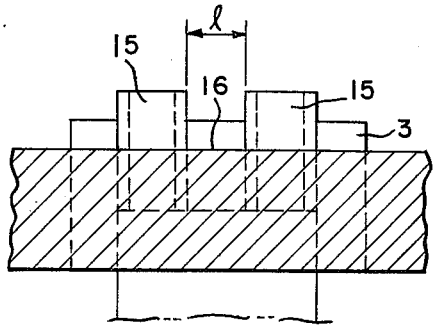

LOW $NO_X$ EMISSION BURNERS

DETAILED DESCRIPTION OF THE INVENTION

The present invention relates to a low $NO_x$ emission burner.

There have been devised and demonstrated various air pollution control methods for reducing the release or emission of nitrogen oxides ($NO_x$) from the commercial and industrial stationary gas-, oil- and coal-fired furnaces which are the main source of air pollution. One of these methods is of the two-stage combustion type, but the more the secondary air is supplied, and the less the first air is reduced the more the unburned fuel is liable to change to CO and soot so that the sufficient reduction in $NO_x$ emission cannot be attained.

Referring to FIGS. 1 through 4, the conventional burner will be described. In a terrace-wall type furnace a shown in FIG. 1, at the bases or bottoms of the inclined walls *b* lined with the refractory material are disposed the burners *c* each comprising an oil burner *d*, gas burners *e*, a primary air duct *f*, and a port or outlet *g* for injecting the primary air. There has been also devised and demonstrated the reversed-terrace-wall type furnace in which the arrangement of each burner *c* is reversed 180° in direction. In the terrace-wall type furnace *a*, the combustion of the fuel injected through the burner *c* takes place along the inclined furnace walls b which serve as the radiation surfaces for radiating the heat to a reaction tube h which is filled with the catalysts and is disposed along the axis of the space enclosed by the furnace walls *b*. Hydrocabon and steam which are charged from the top are made into contact with the reaction tube *h* so that they are subjected to the steam reforming reaction. Therefore, the reaction products containing a large quantity of hydrogen are produced, and hydrogen gas is directed toward the bottom of the furnace.

When the synthesis gas for ammonia or methanol, ethylene synthesizing gas, or the like is produced in the terrace-wall type furnace, the interior of the furnace is heated to elevated temperatures so that $NO_x$ are produced. Thus the quantity of $NO_x$ discharged from the terrace-wall type furnace is the greatest among various furnaces used in the petrolium refining and petrochemical industries so that as of 1974 in Japan the furnaces used for the production of ammonia, methanol and ethylene are excepted from the enforcement of the $NO_x$ emission control law.

In view of the above, the primary object of the present invention is to provide a low $NO_x$ emission burner capable of reducing the emission of not only $NO_x$ but also CO and soot.

Next the preferred embodiments of the present invention will be described in detail with reference to the accompanying drawing in which:

FIG. 1 is a schematic view of one example of the conventional terrace-wall type furnaces using the conventional burners;

FIG. 2 is a fragmentary sectionary view, on enlarged scale, of the conventional burner;

FIG. 3 is a side view thereof looking in the direction indicated by the arrows III — III in FIG. 2;

FIG. 4 is a side view thereof looking in the direction indicated by the arrows IV — IV in FIG. 2;

FIG. 5 is a longitudinal sectional view of a first preferred embodiment of a burner in accordance with the present invention;

FIG. 6 is a side view thereof looking in the direction indicated by VI — VI in FIG. 5;

FIG. 7 is a sectional view of a second preferred embodiment of the present invention;

FIG. 8 is a side view thereof looking in the direction indicated by the arrows VIII — VIII in FIG. 7;

FIG. 9 is a side view looking in the direction indicated by the arrows IX — IX of FIG. 7.

Figure 10:
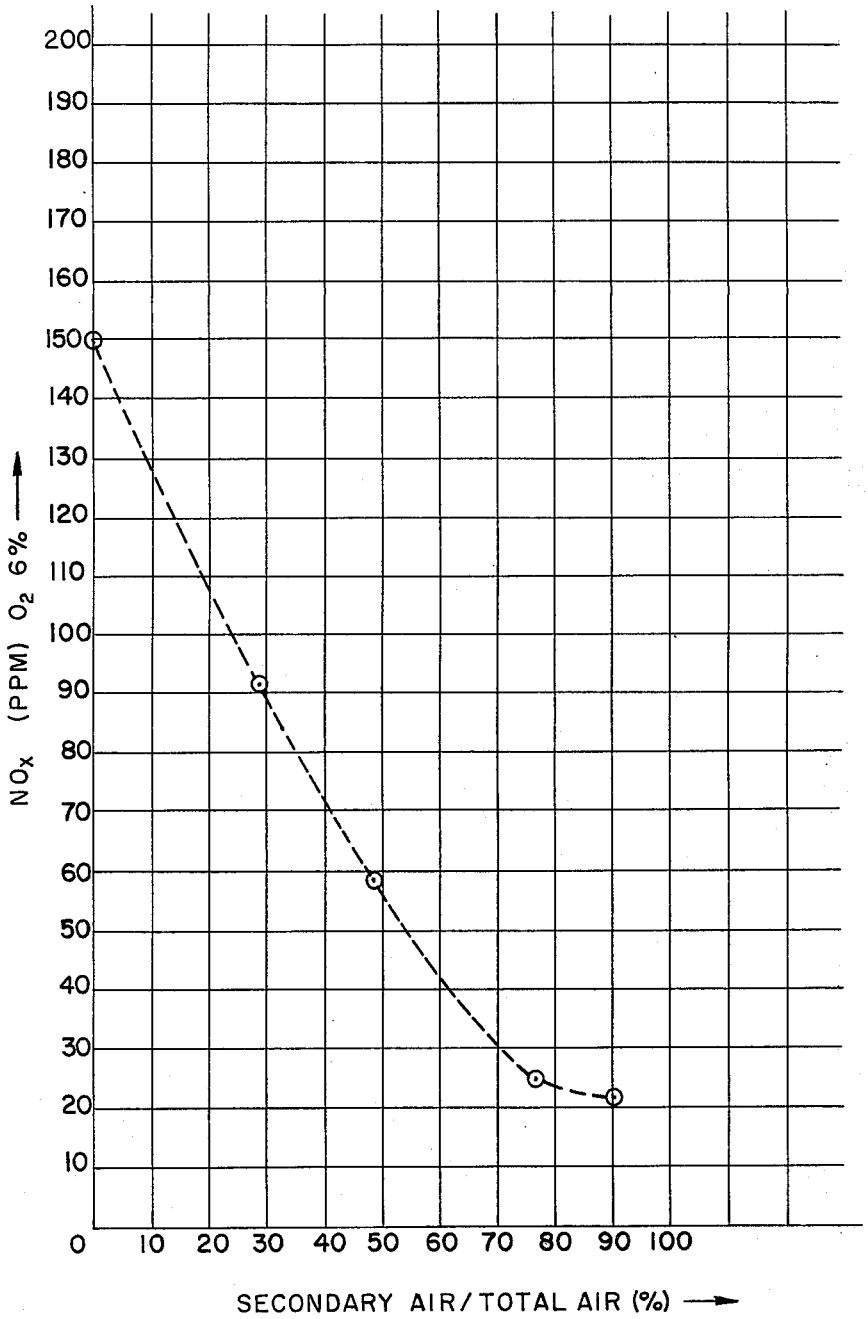
FIG. 10 is a graph illustrating the relationship between the secondary air/total air and $NO_x$ (PPM) at 6% $O_2$.

Referring first to FIGS. 5 and 6, a burner tile 3 is placed between a furnace bed 1 and a furnace wall 2, which extends upwardly and whose inner surface defines a radiation surface, in such a way that the top surface of the burner tile 3 may be raised above or extended beyond the top surface of the furnace bed 1 into the interior of the furnace. Within the burner tile 3 is formed a primary air injection port or outlet 5 whose inner wall 4 in the vicinity of its opening is inclined upwardly toward the furnace wall 2. Within the primary air injection port or outlet 5 is placed a partition wall 6 so that the primary air injection port 5 may be divided into two spaces. In one space are placed a plurality of gas burners 7 in such a way that the upper ends or nozzles are substantially as high as the upper edge of the partition wall 6. In the other space defined by the partition wall 6 is disposed an oil burner 8 in such a way that its upper end or nozzle is slightly below the bottom of the other space. The primary air injection outlet 5 is communicated with a primary duct 10 provided with a primary air damper 9.

Within the burner tile 3 remote from the furnace wall 2 are formed four secondary air injection ports or outlets 12 whose each inner wall is inclined upwardly toward the furnace wall 2 and which are communicated with a secondary air duct 14 provided with a secondary air damper 13. It is very important to select the position and design of the secondary air injection outlets 12 in such a way that the secondary air injected as indicated by the broken arrows A and B in FIG. 5 may be prevented from interferring with the flame in the furnace and may cause the complete combustion of the fuel. Reference characters (A) and (B) indicate the lower and upper limits where the secondary air impinges against the furnace wall 2.

The gas fuel is injected through the gas burners 7, the oil fuel is injected through the oil burner 8, the primary air is charged through the primary air injection outlet 5, and the secondary air is injected through the secondary air injection outlet 12 into the zone enclosed by the broken arrows (A) and (B) so that the combustion takes place in the furnace.

The fuel unburned in the combustion with the primary air flows upwardly along the furnace wall 2 while being heated in excess of its ignition point by the heat radiated from the furnace wall or radiation surface 2 so that the unburned fuel may be completely burnt with the secondary air. Therefore even when the supply of the primary air is extremely reduced so that the quantity of the secondary air is 60–90% of the total quantity of the primary and secondary air injected into the furnace, the combustion may take place without producing CO and soot. Since a large quantity of the secondary air is charged into the furnace, the combustion is dependent upon the secondary air distribution and the rapid combustion is prevented. Thus, there exists no local spot which is exceedingly heated so that the production of $NO_x$ may be considerably reduced.

When the cross section of the secondary air injection outlet 12 taken perpendicular to the direction of the secondary air flow is made triangular as shown in FIG. 6, the secondary air may be charged very effectively into the zone where a large quantity of fuel exists so that the combustion may take place with a constant fuel-air ratio.

Next referring to FIGS. 7, 8 and 9, the second embodiment of the present invention will be described which is substantially similar in construction to the first embodiment shown in FIGS. 5 and 6 except the construction of the secondary air injection outlets or ports 12. That is, two tiles 15 for a secondary air injection outlet are placed between the burner tile 3 and the furnace bed 1 in such a way that the upper surface of each tile 15 is raised above that of the burner tile 3 as best shown in FIG. 9 and that the tiles 15 are spaced apart from each other by a predetermined distance *l* so as to form a valley portion 16 there between. In each tile 15 is formed the secondary air injection outlet 12 whose inner wall 11 is inclined upwardly toward the furnace wall 2 as with the case of the first embodiment and which is communicated with a secondary air header or duct 17 provided with the damper 13.

The mode of operation is substantially similar to the first embodiment. It is also very important to select the position and design of the secondary air injection ports 12 in such a way that the lower limit at which the secondary air impinges against the furnace wall 2 must be away from the flame while the upper limit at which the secondary air impinges the furnace wall must be above the zone in which the fuel heated in excess of its ignition point by the heat radiated from the furnace wall is burned with the secondary air. Thus, as with the case of the first embodiment, the complete combustion takes place without producing CO and soot and the release of $NO_x$ may be extremely reduced.

The opening of the secondary air injection port 12 is above the top surface of the burner tile 3 so that the secondary air may be prevented from being swirled or entrained into the primary air and the jets of the injected fuel. As a result, the combustion with the secondary air in the lower portion close to the burner tile 3; that is, the combustion which takes place below the radiation surface of the furnace wall 2 will not take place. The valley portion 16 is provided between the tiles 15 so that the secondary air injected entrains the combustion gases with a low oxygen partial pressure so that the oxygen partial pressure in the zone below the radiation surface may be decreased. As a result the combustion may be retarded. Furthermore, the secondary air is charged along the main stream or flow of the combustion gas within the furnace so that the secondary air charged may flow upwardly smoothly without preventing the upward flow of the fuel. The interference between the secondary air flows or jets and the fuel jets may be positively prevented so that the production of soot caused by the carbonization of the retarded fuel may be positively prevented. Moreover, the misfiring of the gas and oil burners 7 and 8 due to the adhesion of soot to the furnace wall 2 may be prevented.

FIG. 10 is a graph illustrating the relationship between the secondary air/total air and $NO_x$ (PPM) at 6% $O_2$ obtained by the low $NO_x$ emission burners in accordance with the present invention. It is seen that when the secondary air is increased in quantity, the release or production of $NO_x$ is reduced accordingly. The quantity of $NO_x$ at the secondary air/total air ratio=0% is equal to that produced by the conventional burners.

So far the secondary air injection ports or outlets have been described as being four in the first embodiment and two in the second embodiment, but it is to be understood that the number of the secondary air injection ports is not limited. For instance, in the first embodiment any number (including one) of secondary air injection outlets may be provided while in the second embodiment a plurality number (more than two) of secondary air injection outlets may be provided. It should be noted that the larger the number of secondary air injection outlets, the more uniform the combustion along the radiation surface becomes. The cross section of the secondary air injection outlet or port is not limited to triangular and square as shown in the first and second embodiments, respectively. Any suitable cross sectional configuration may be selected depending upon the kinds of fuel, the configuration of the furnace wall, and so on. In the second embodiment, two tiles 15 are shown, but it is understood that only one tile provided with two secondary air injection ports and a valley portion formed therebetween may be used. Instead of the tile, any refractory alloy may be, of course, used. Instead of upwardly injecting the fuel and primary and secondary air, they may be downwardly injected into the furnace by the oil and gas burners and the primary and secondary air injection ports located at the furnace ceiling instead of the furnace bed. The secondary air injection ports or outlets may be disposed in the furnace wall in opposition to the radiation surface thereof so that the lateral or horizontal combustion may take place. In addition to the above, various modifications may be effected without departing the true spirit of the present invention.

As described above, according to the present invention, the production or release of $NO_x$ may be reduced by the supply of the secondary air without the production of CO and soot by 80 to 90% as compared with the conventional burners.

What is claimed is:

1. A low $NO_x$ emission burner and furnace construction wherein the furnace is provided with a floor and an upstanding wall, the floor being provided with a primary air injection passage closely adjacent said wall, said passage having an outlet in said furnace angularly directed toward said wall, liquid fuel and gaseous fuel nozzles positioned in said passage, the floor being also provided with a secondary air injection passage separate from the primary air passage, and said secondary air passage having an outlet in the furnace angularly directed toward said wall, said last named outlet being separate from the first named outlet and being positioned at a greater distance from the furnace wall than the first named outlet.

2. A low $NO_x$ emission burner as set forth in claim 1 wherein a plurality of secondary air injection outlets are formed along said furnace wall and extended into the interior of said furnace beyond said primary air injection outlet, and are spaced apart from each other so that a valley portion may be formed therebetween.

3. A low $NO_x$ emission burner as set forth in claim 2 wherein said secondary air injection outlets are communicated with a secondary air header at the lower openings thereof.

4. A burner as set forth in claim 1 wherein the outlet of the secondary air injection passage extends into the furnace a distance further than the outlet of the primary injection passage.

* * * * *